US011172797B1

(12) United States Patent
Olmsted

(10) Patent No.: US 11,172,797 B1
(45) Date of Patent: Nov. 16, 2021

(54) SPACE-SAVING DEVICE AND METHOD FOR BATHROOMS

(71) Applicant: James H. Olmsted, Stateline, NV (US)

(72) Inventor: James H. Olmsted, Stateline, NV (US)

( * ) Notice: Subject to any disclaimer, the term of this patent is extended or adjusted under 35 U.S.C. 154(b) by 0 days.

(21) Appl. No.: 16/849,838

(22) Filed: Apr. 15, 2020

Related U.S. Application Data

(60) Provisional application No. 62/836,002, filed on Apr. 18, 2019.

(51) Int. Cl.

| | |
|---|---|
| ***A47B 67/02*** | (2006.01) |
| ***A47K 17/00*** | (2006.01) |
| ***A47B 95/00*** | (2006.01) |
| ***A47B 96/00*** | (2006.01) |
| ***E05D 7/12*** | (2006.01) |
| ***A47B 47/00*** | (2006.01) |
| ***E05F 5/06*** | (2006.01) |

(52) U.S. Cl.
CPC ..... *A47K 17/00* (2013.01); *A47B 47/00* (2013.01); *A47B 95/008* (2013.01); *A47B 96/00* (2013.01); *E05D 7/123* (2013.01); *E05F 5/06* (2013.01); *E05Y 2900/20* (2013.01)

(58) Field of Classification Search
CPC ..... A47B 67/02; A47B 96/00; A47B 96/008; A47B 95/008; A47B 47/00; A47K 17/00; E05D 7/123
See application file for complete search history.

(56) References Cited

U.S. PATENT DOCUMENTS

| | | | | |
|---|---|---|---|---|
| 809,592 A * | 1/1906 | Watts | A47B 67/02 312/242 |
| 2,166,430 A * | 7/1939 | Green | A47B 67/02 49/70 |
| 2,584,438 A * | 2/1952 | Du Boff | A47B 67/02 312/199 |
| 3,240,547 A * | 3/1966 | Erskine | A47B 53/00 312/274 |

(Continued)

*Primary Examiner* — Kimberley S Wright
(74) *Attorney, Agent, or Firm* — Stout, Uxa & Buyan, LLP; Donald E. Stout

(57) ABSTRACT

A wall-mounted enclosure is provided to store bathroom supplies within the vacant space between the studs of standard residential framing. The device can either be mounted to existing drywall or mounted directly to a stud before drywall is applied to the standard residential framing. The device also includes a trim structure to conceal any gaps between the drywall cutaway and the device. The device includes individual compartments to store various bathroom supplies such as tissue paper rolls, air fresheners, cleaning supplies, personal hygiene supplies, and the like. The compartments are assessable through conveniently hinged compartment doors that protrude from the drywall surface. By placing this device within the space between framing studs, this allows the user to utilize storage space that was previously inaccessible, increasing convenience and overall storage space. This also provides better access to necessary bathroom necessities in smaller spaces where there is no preexisting storage. While the present invention may be used in residential bathrooms, the device may also be used in rooms of other function, for other items, and may also be used in commercial buildings.

6 Claims, 10 Drawing Sheets

(56) References Cited

U.S. PATENT DOCUMENTS

| | | | | | |
|---|---|---|---|---|---|
| 4,073,554 | A * | 2/1978 | Oder | A47B 87/02 | 109/53 |
| 4,608,932 | A * | 9/1986 | Bohland | E05G 1/08 | 109/53 |
| 4,641,898 | A * | 2/1987 | Horowitz | A47K 10/40 | 108/50.17 |
| D358,052 | S * | 5/1995 | Carpenter | D6/519 | |
| 5,435,255 | A * | 7/1995 | Elseser | E05G 1/08 | 109/56 |
| 5,707,125 | A * | 1/1998 | Coglin | A47B 95/008 | 312/242 |
| 7,407,237 | B2 * | 8/2008 | Bright | A47B 67/02 | 312/242 |
| 7,464,999 | B2 * | 12/2008 | Quinn | A47B 43/00 | 312/258 |
| 7,967,400 | B1 * | 6/2011 | Collum | A47B 81/00 | 312/246 |
| 8,167,387 | B1 * | 5/2012 | Quinn | A47B 43/00 | 312/258 |
| 8,833,876 | B2 * | 9/2014 | Lee | A47G 25/06 | 312/242 |
| 2003/0090177 | A1 * | 5/2003 | Posvar | A47B 96/00 | 312/205 |
| 2004/0130245 | A1 * | 7/2004 | Pinto | A47K 10/40 | 312/34.23 |
| 2008/0180007 | A1 * | 7/2008 | Quinn | A47B 43/00 | 312/258 |
| 2019/0186173 | A1 * | 6/2019 | Johnson | A47B 77/02 | |

* cited by examiner

SPACE-SAVING DEVICE AND METHOD FOR BATHROOMS

This application claims the benefit under 35 U.S.C. 119(e) of the filing date of Provisional U.S. Application Ser. No. 62/836,002, entitled Space-Saving Device and Methods for Bathrooms, filed on Apr. 18, 2019, which is expressly incorporated herein by reference, in its entirety.

BACKGROUND OF THE INVENTION

In typical households, bathrooms offer limited floor, counter, and storage space. Typical bathroom necessities and supplies further limit the functional space of household bathrooms. Items such as tissue paper holders, spare tissue paper rolls, cleaners, air fresheners, and personal hygiene supplies contribute to this limitation of space. The present invention makes use of the fact that most homes in the developed world implement standard framing construction, which includes a considerable amount of inaccessible spacing within the walls. The present invention efficiently and attractively utilizes this space to give the user convenient access to various bathroom supplies while maximizing the efficiency of the bathroom space. The present invention is even more useful in bathrooms that have limited to no storage, small floor space, or where improved organization is desired.

SUMMARY OF THE INVENTION

The present invention is a device to store bathroom supplies within the vacant space between the studs of standard residential framing. The device can either be mounted to existing drywall or mounted directly to a stud before drywall is applied to the standard residential framing. The device also includes a trim structure to conceal any gaps between the drywall cutaway and the device. The device includes individual compartments to store various bathroom supplies such as tissue paper rolls, air fresheners, cleaning supplies, personal hygiene supplies, and the like. The compartments are assessable through conveniently hinged compartment doors that protrude from the drywall surface. The device may also advantageously include a convenient tissue paper roll holder to further save space. The user may use this device exclusively for tissue paper, other bathroom paraphernalia, or a combination thereof. By placing this device within the space between framing studs, this allows the user to utilize storage space that was previously inaccessible, increasing convenience and overall storage space. This also provides better access to necessary bathroom necessities in smaller spaces where there is no preexisting storage. The storage compartments consist of a plurality of storage rows and columns or of a singular storage compartment. While the present invention may be used in residential bathrooms, the device may also be used in rooms of other function, for other items, and may also be used in commercial buildings.

In one exemplary aspect of the invention, there is provided a bathroom storage system, which comprises an enclosure having a shelf structure with a back wall, opposing side walls, a bottom wall, and a top wall, an interior volume defined by the back wall, opposing side walls, the top wall, and the bottom wall, and a front opening. At least one door is secured to one of the opposing side walls by a plurality of vertically spaced hinges, the hinges permitting movement of the at least one door between a closed position wherein the at least one door covers the front opening and an open position, wherein the front opening is exposed for access to the interior volume. A trim structure extends outwardly from each of the top wall, bottom wall, and opposing side walls so that the trim structure surrounds the entire enclosure. A plurality of vertically spaced shelves are removably secured within the interior volume of the enclosure.

Mounting tabs are disposed on opposing ends of each of the top wall and the bottom wall, the mounting tabs being adapted for securement of the enclosure to adjacent wall structure to mount the enclosure to a room wall. Accordingly, when the enclosure is mounted to the room wall, the trim structure is adapted to lie flush on an exterior surface of the room wall and to cover any gap between the room wall and the shelf structure.

Trim attachment holes are disposed in the shelf structure which are adapted to receive fasteners which attach the trim structure to the shelf structure. A tissue paper roll holder may be disposed in the interior volume. The trim structure further comprises a protruding structure, the protruding structure extending the shelves, the opposing side walls, the top wall, and the bottom wall forwardly from a plane of the room wall when the enclosure is mounted to the room wall.

The plurality of vertically spaced hinges are disposed on the protruding structure, in exemplary embodiments, the protruding structure further comprising a plurality of vertically spaced receiving magnet holders, with the plurality of vertically spaced receiving magnet holders being disposed on the opposing side of the protruding structure, relative to the plurality of vertically spaced hinges. Thus, the plurality of vertically spaced receiving magnet holders are engageable with a corresponding plurality of magnet holders disposed on the at least one door, so that when the at least one door is swung to its closed position, engagement of the plurality of magnet holders with corresponding ones of the receiving magnet holders retains the at least one door in its closed position. In an exemplary embodiment, the plurality of hinges are recessed within outer boundaries of the trim structure when the at least one door is in its closed position, one or more of the plurality of hinges comprising a hinge removal hole to facilitate easy removal of the at least one door for purposes of modularity.

In one exemplary embodiment, each of the mounting tabs comprises a flange having a pair of spaced fastener holes disposed therein, each of the mounting tabs being adapted for attachment to adjacent framing studs. In another exemplary embodiment, each of the mounting tabs further comprise a mounting tab slide having a lip, wherein the mounting tabs and mounting tab slides are adapted to clamp adjacent drywall against the lip of the mounting tab slide to thereby secure the shelf structure to the drywall. In this embodiment, the mounting tabs are free-floating and rotatable to lie flat along the top wall of the shelf structure when the shelf structure is inserted into a hole in the drywall, and then are rotatable to extend upwardly to secure the shelf structure to the wall.

The invention, together with additional features and advantages thereof, may be best understood by reference to the following description taken in conjunction with the accompanying illustrative drawings. In these accompanying drawings, like reference numerals designate like parts throughout the figures.

DETAILED DESCRIPTION OF THE INVENTION

Figure 2:
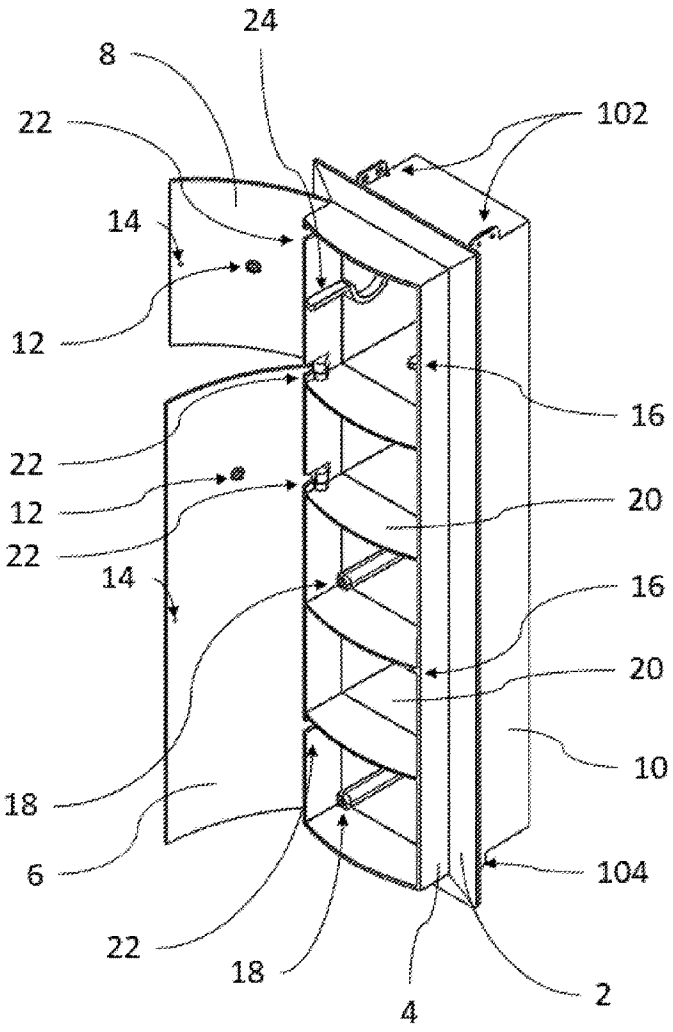
FIG. 2 is another isometric view, similar to FIG. 1, illustrating the interior of the embodiment shown in FIG. 1.
Figure 1:
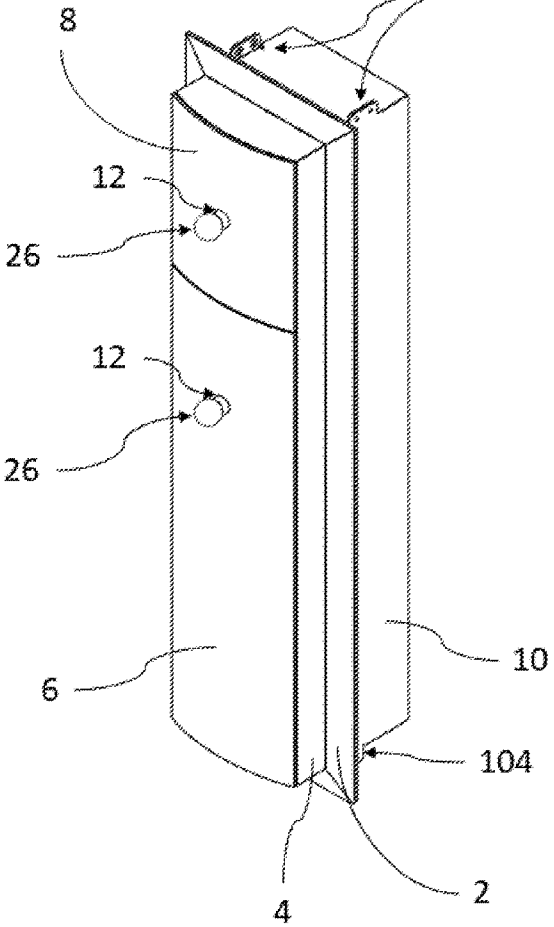
FIG. 1 is an isometric view of an exemplary embodiment of the present invention that is ideal for mounting during standard framing construction.
Figure 4:
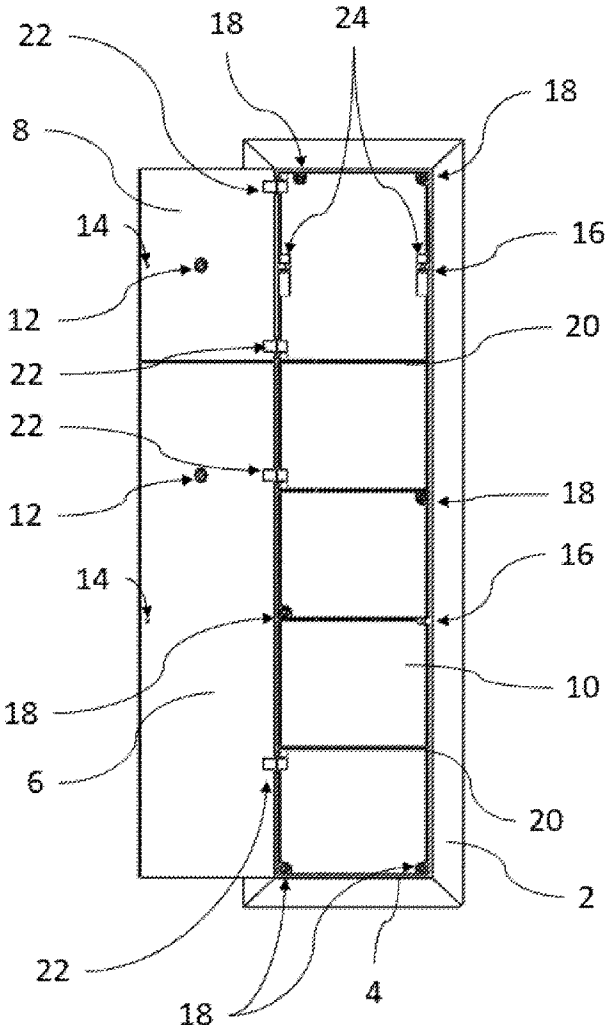
FIG. 4 is a front view similar to FIG. 3, wherein doors are in an open position to reveal an exemplary interior construction of the embodiment shown in FIGS. 1-3.
Figure 3:
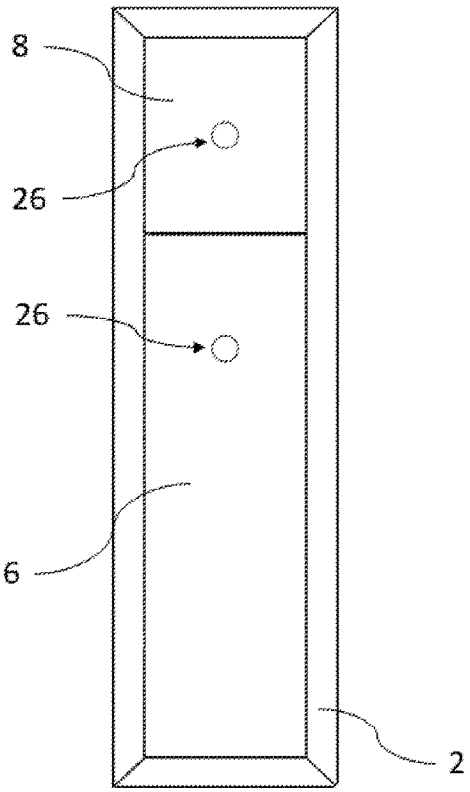
FIG. 3 is a front view of the embodiment shown in FIGS. 1 and 2.
Figure 6:
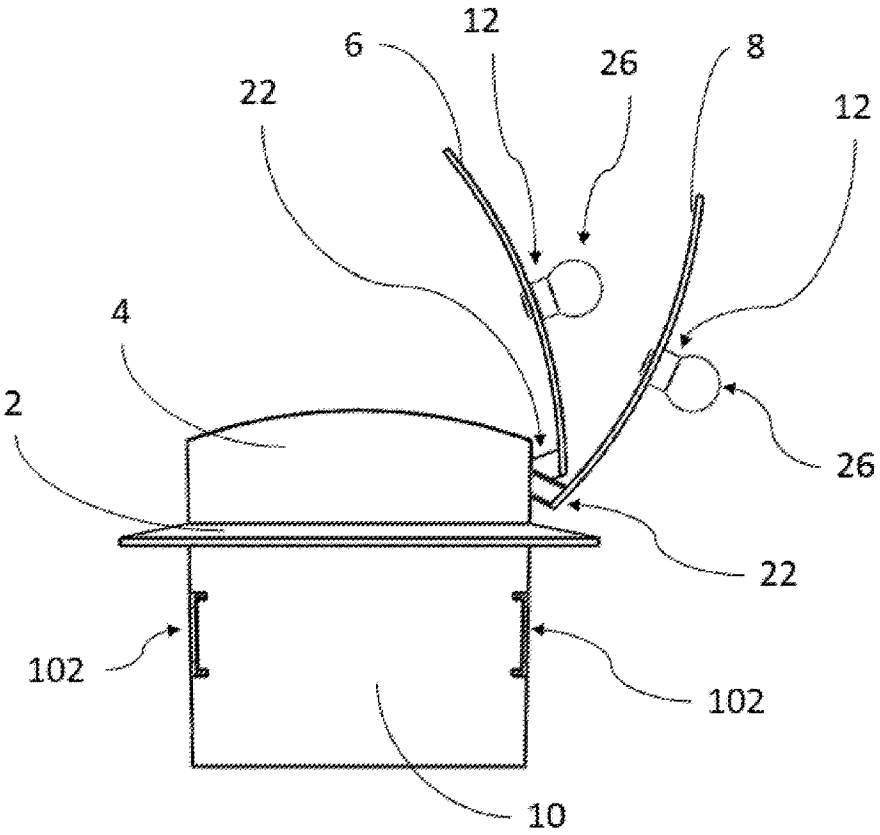
FIG. 6 is a top view similar to FIG. 5, with the doors in an open position.
Figure 5:
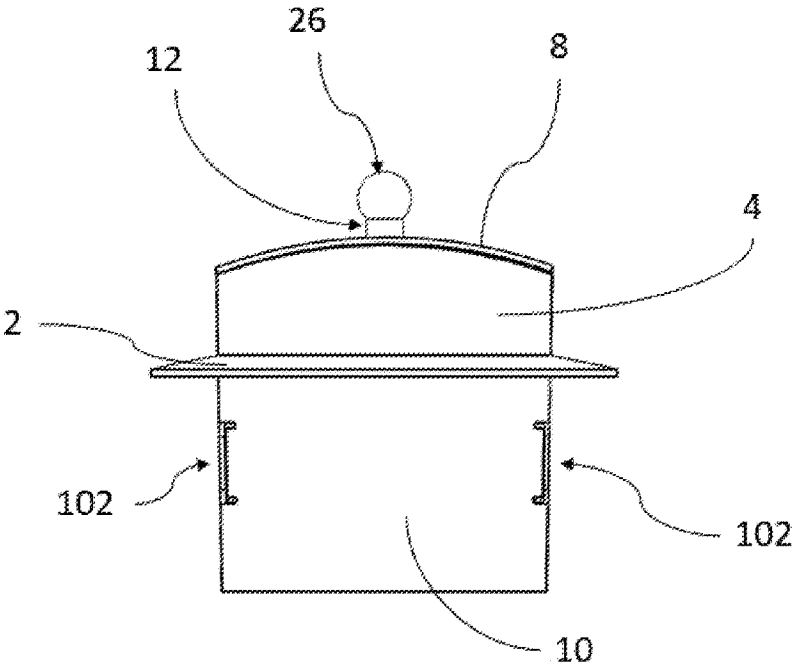
FIG. 5 is a top view of the embodiment shown in FIGS. 1-4, with the doors in a closed position.
Figure 8:
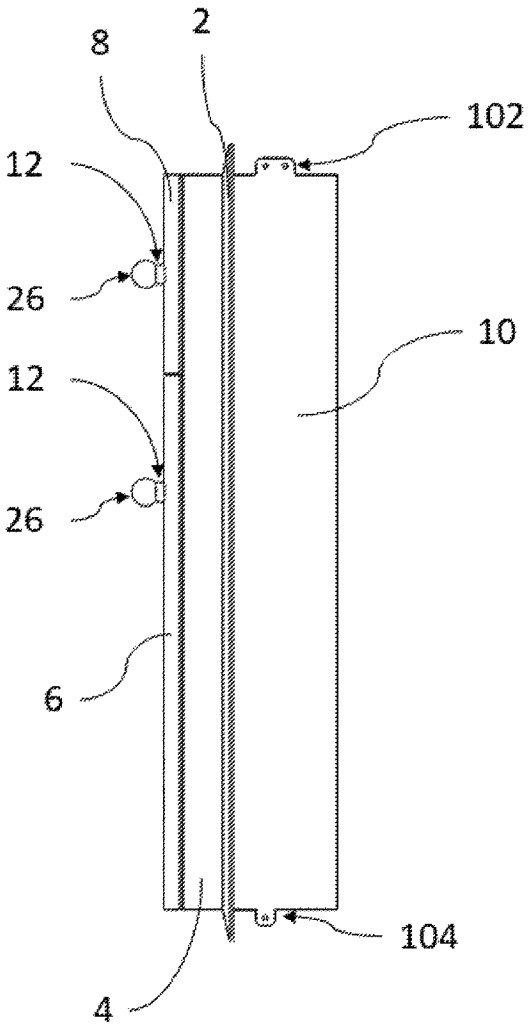
FIG. 8 is a side view of the embodiment shown in FIGS. 1-7.
Figure 7:
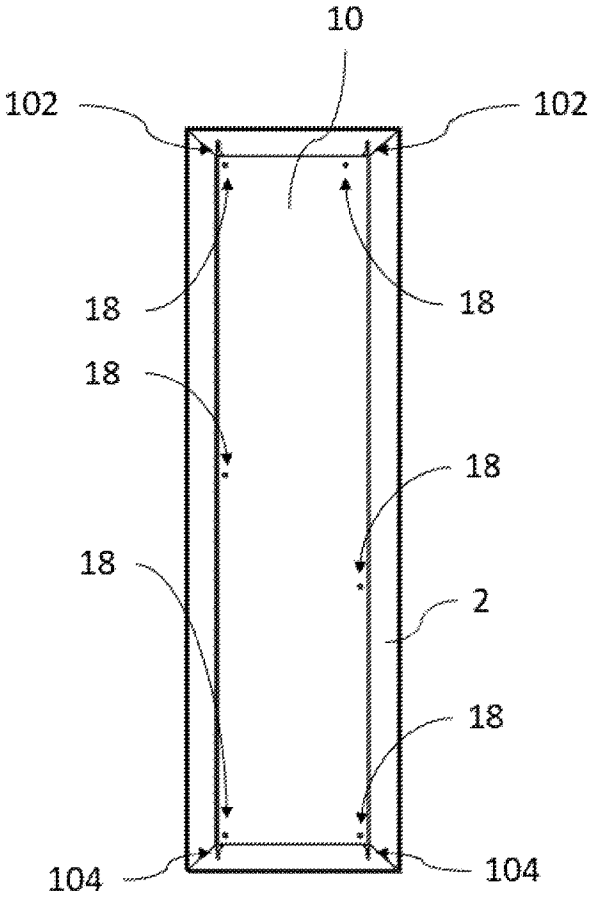
FIG. 7 is a rear view of the embodiment shown in FIGS. 1-6.
Figure 10:
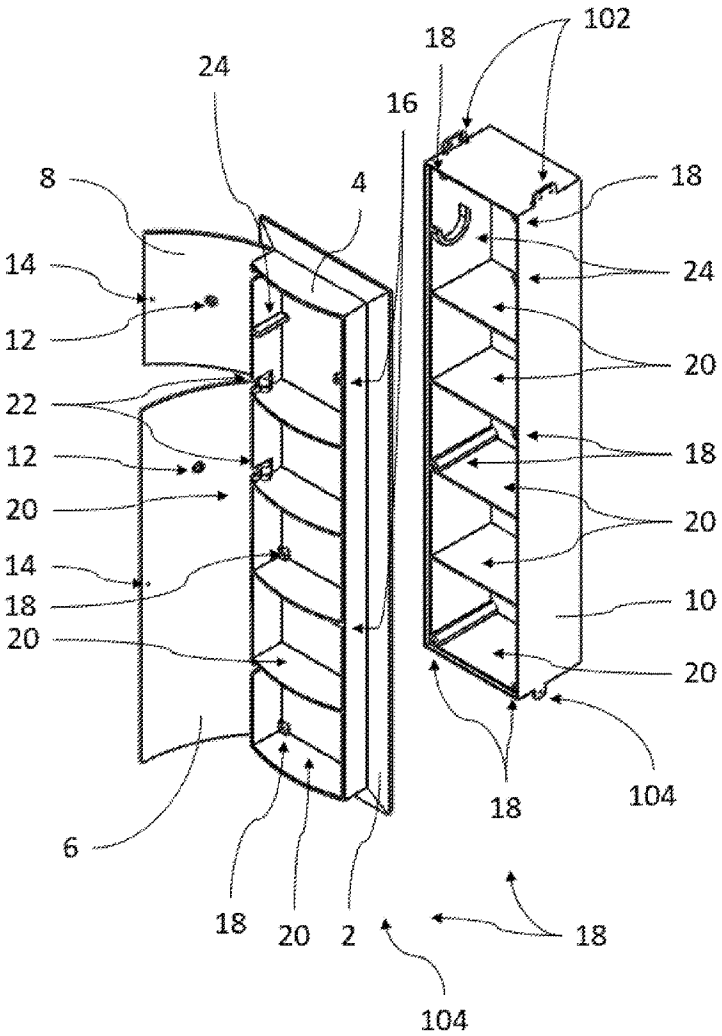
FIG. 10 is an exploded rear isometric view of the embodiment shown in FIGS. 1-9.
Figure 9:
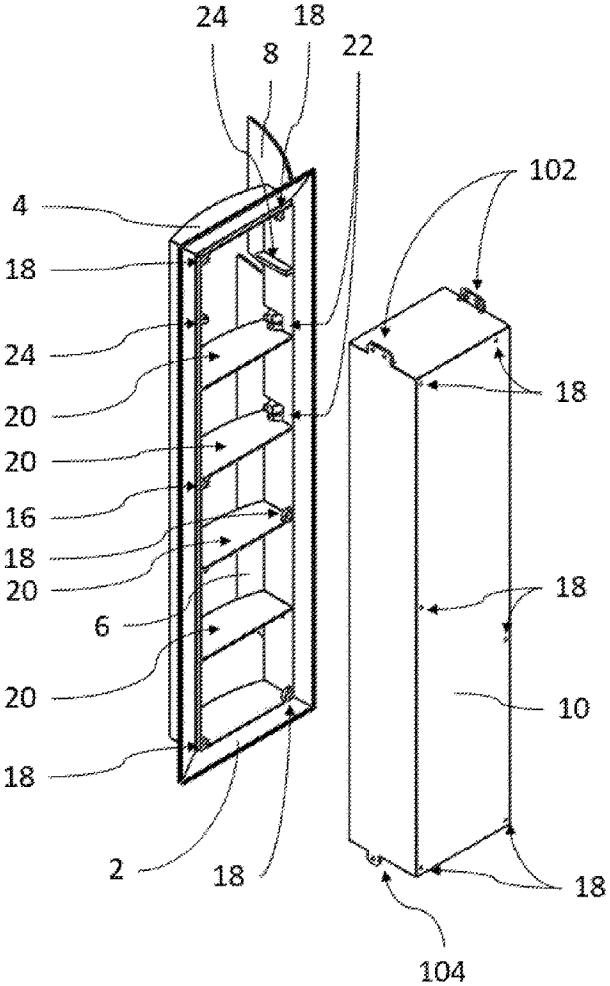
FIG. 9 is an exploded front isometric view of the embodiment shown in FIGS. 1-8.
Figure 12:
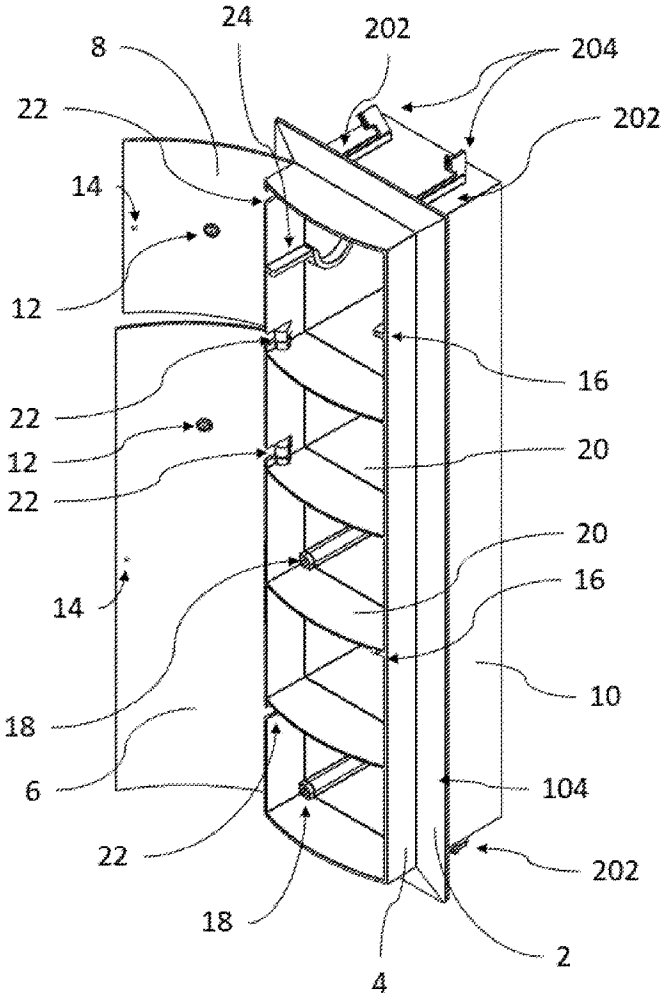
FIG. 12 is an isometric view similar to FIG. 11, wherein the doors are in an open position to illustrate the interior of the embodiment shown in FIG. 11.
Figure 11:
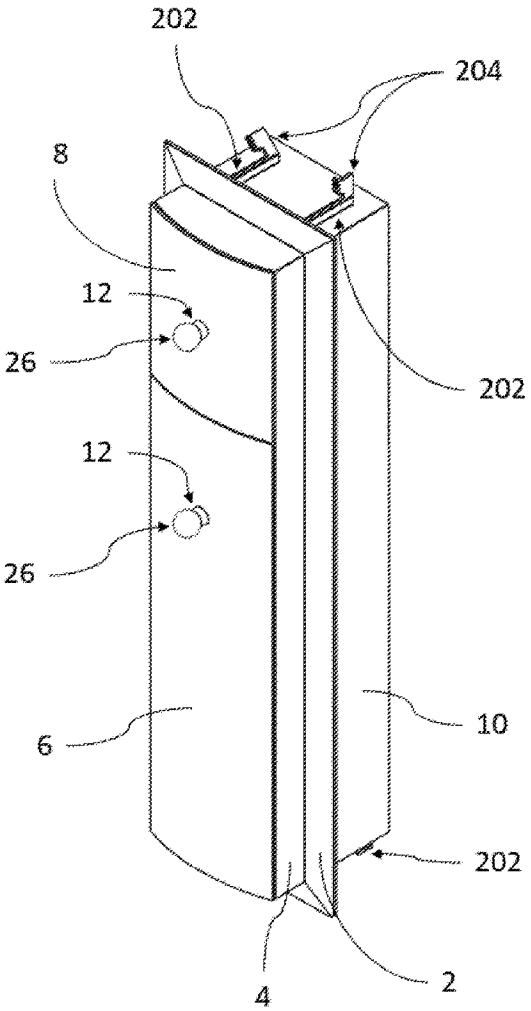
FIG. 11 is an isometric view illustrating another modified exemplary embodiment of the present invention that is optimized for retrofit mounting to existing drywall mounted to framing studs.
Figure 14:
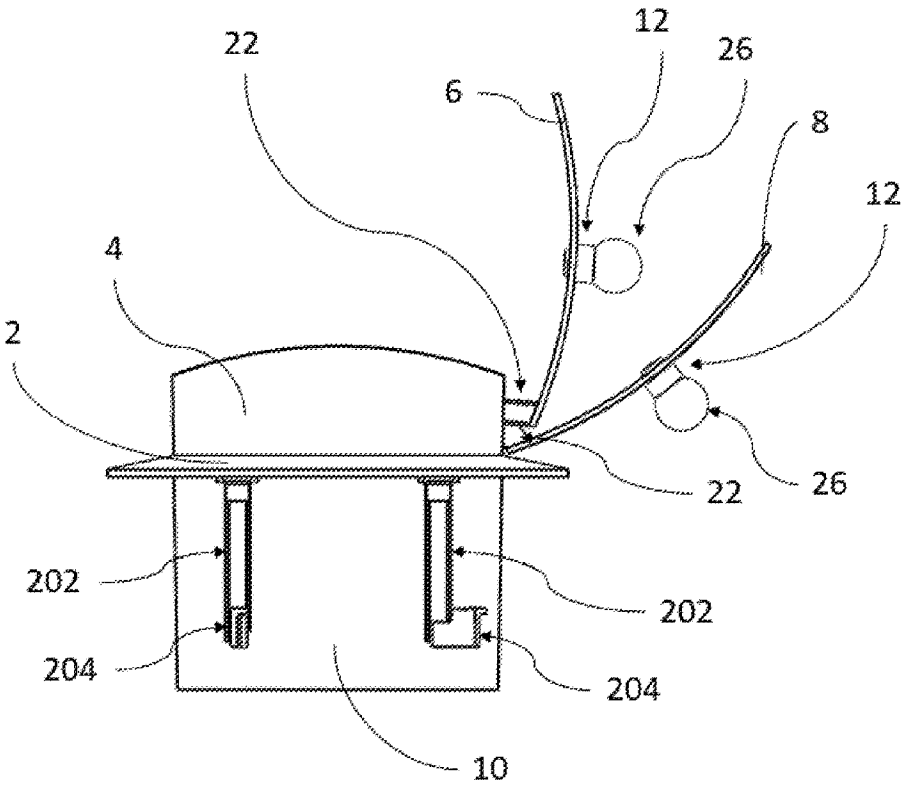
FIG. 14 is a top view similar to FIG. 13, wherein the doors are open.
Figure 13:
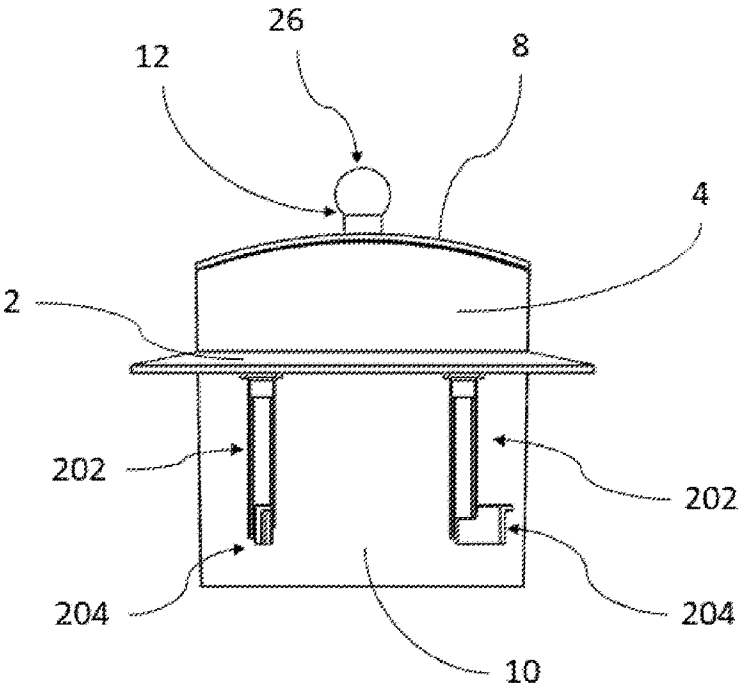
FIG. 13 is a top view of the embodiment shown in FIGS. 11 and 12.
Figure 16:
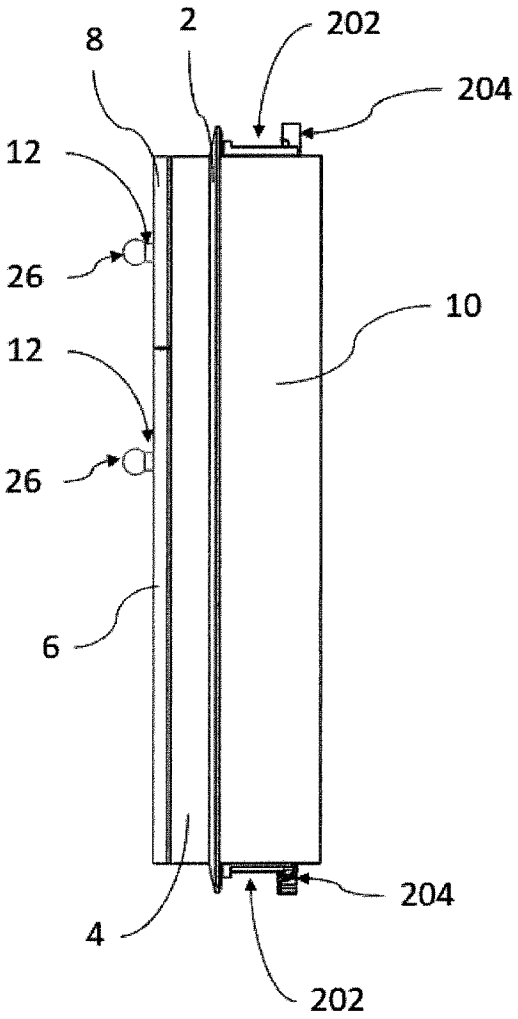
FIG. 16 is a side view of the embodiment shown in FIGS. 11-15.
Figure 15:
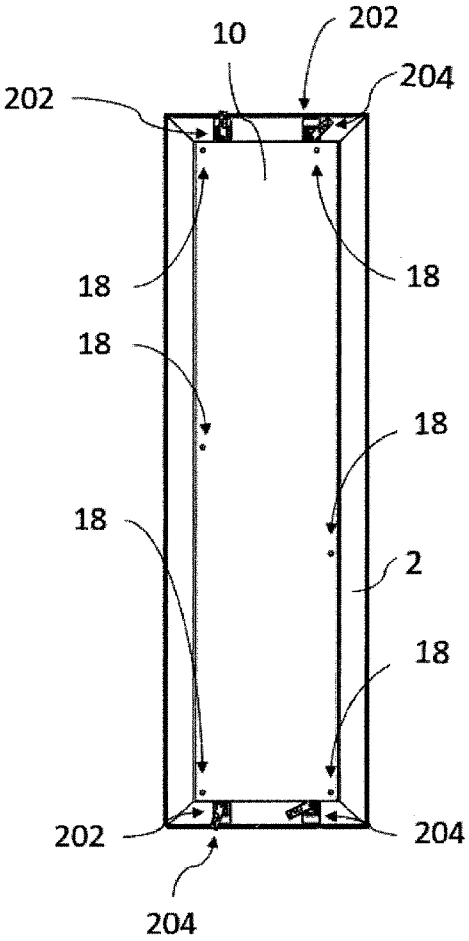
FIG. 15 is a rear view of the embodiment shown in FIGS. 11-14.
Figure 18:
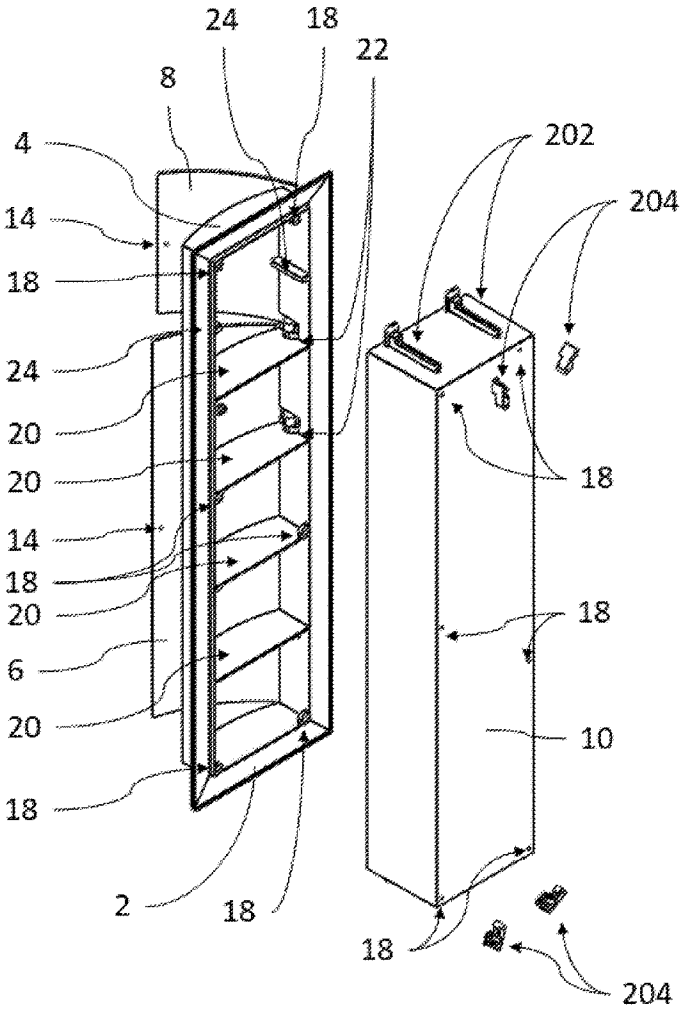
FIG. 18 is an exploded rear isometric view of the embodiment shown in FIGS. 11-17.
Figure 17:
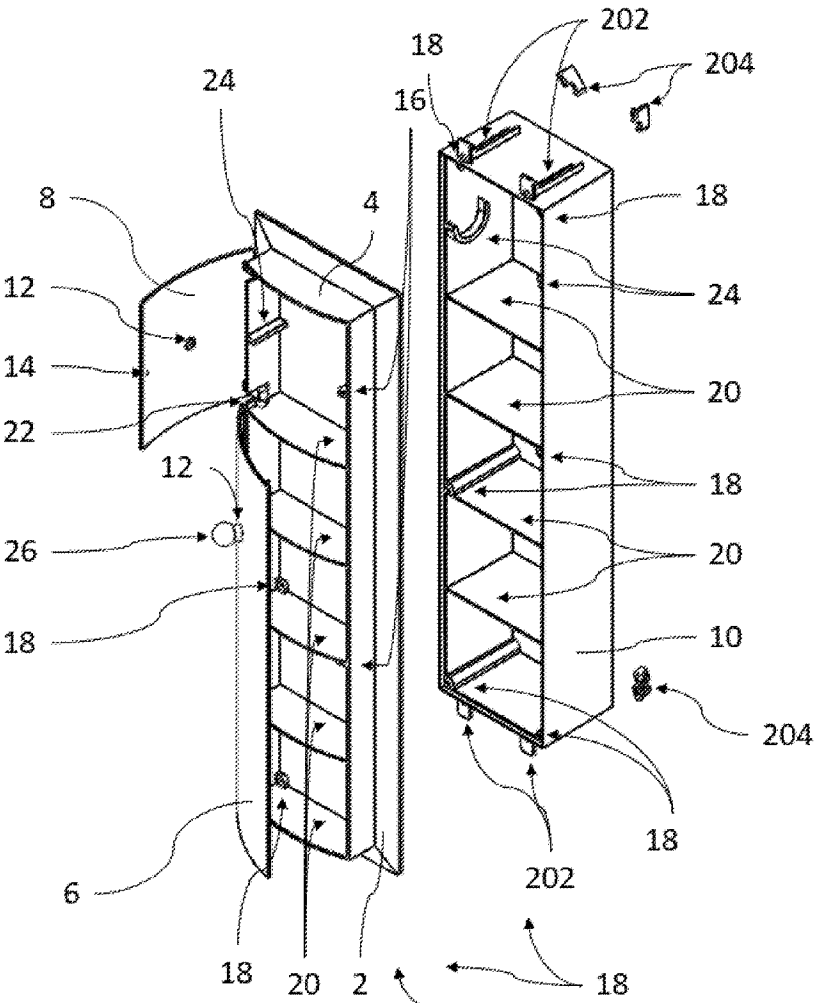
FIG. 17 is an exploded front isometric view of the embodiment shown in FIGS. 11-16.

Referring now more particularly to the drawings, there is shown in FIG. 1-10, an exemplary embodiment of a space-saving device or enclosure which is constructed in accordance with an embodiment of the present invention. The embodiment comprises a shelf structure 10 that is connected directly to the side of a framing stud by a top mounting tab 102 and a bottom mounting tab 104. The shelf structure 10 is dimensioned to be flush with the back side of a framing stud. The interior of the shelf structure 10 is comprised of shelves 20, trim attachment holes 18, and a tissue paper roll holder 24. Using trim attachment holes 18, trim structure 2 is attached to the shelf structure 10. The trim structure 2 lays flush with the exterior surface of the drywall and covers any gap between the drywall and the shelf structure 10. The trim structure 2 has a protruding structure 4 that further extends the shelves 20, the trim attachment holes 18, and the tissue paper roll holder 24 from the plane of the drywall surface. The protruding structure 4 also comprises a plurality of hinge features or hinges 22 and receiving magnet holders 16. The hinges 22, shown in greater detail in FIGS. 19 and 20, may be comprised of spring plungers, dowel pins, hinge pins, snap fits, or any other suitable assembly that allows for rotation, and may be of any material including but not limited to stainless steel, aluminum, steel, iron, and acrylonitrile butadiene styrene. The device includes an upper door 8 and a lower door 6 but may include any number of doors. Each door 8, 6, includes at least one hinge 22, at least one magnet holder 14, and at least one knob mount 12. When the doors 8, 6, are closed the magnet holder 14 mates with one of the receiving magnet holders 16 in order to prevent the door from unintentionally opening. The magnets within the magnet holder 16, 14, may be a ferrous magnet, rare earth magnet, magnetic strip, or any other material of suitable magnetic strength. A knob 26, which may be constructed from steel, stainless steel, aluminum, chromium, brass, copper, plastic, wood, ceramic, glass, quartz, elastomer, or any other material, or a combination thereof is attached to the knob mount 12. The knob 26 may also be coated with any other desired material such a chrome, gold, copper, zinc, elastomer, or polymer, in order to reach desired aesthetics and function.

Another exemplary embodiment of the present invention, now referring to FIGS. 11-18, is particularly designed for retrofit mounting to previously mounted drywall sheet. The main difference between this embodiment, FIGS. 11-18, and the previous embodiment, FIGS. 1-10, are the mounting tabs 204 and the mounting tab slides 202 in place of the previous top mounting tab 102 and bottom mounting tab 104. The purpose of these mounting tabs 204 is to clamp the drywall against the lip of the mounting tab slides 202 thus securing the shelf structure 10 to the wall. A suitable sized rectangular hole is cut into existing drywall and the shelf structure 10 is placed within the hole. The free-floating mounting tabs 204 are partially threaded by a suitable screw through the holes provided by the mounting tab slides 202. The tabs are rotated to lay flat along the top exterior surface of the shelf structure 10 as the shelf structure 10 is inserted into the drywall hole. Once in place, the design of the mounting tabs 204 allow them to be flipped upward as the screws are tightened, eventually making contact with the inside of the drywall and clamping the drywall against the mounting tap slides 202, thus securing the shelf structure 10. Similarly to the previous embodiment, FIGS. 1-10, the trim structure 2 is then mounted to the shelf structure 10 using the attachment holes 18. Otherwise, this modified embodiment comprises many of the same features as the previous embodiment, such as receiving magnet holders 16 and hinges 22, as well as the shelves 20, the tissue paper roll holder 24, and the attachment holes 18. This embodiment FIGS. 11-18 similarly also features a top door 8 and a bottom door 6, both of which include a magnet holder 14, a knob mount 12, at least one hinge 22 and at least one knob 26.

The entirety of the present invention, and its various representative embodiments, as illustrated in FIGS. 1-18, may be constructed from any suitable material or combination thereof, including but not limited to: acrylonitrile butadiene styrene, polycarbonate, polyvinyl chloride, polylactic acid, polypropylene, high impact polystyrene, polyamide, silicone, polyurethane, polyethylene, aluminum, stainless steel, copper, steel, brass, glass, quartz, ceramic, elastomer, polymer and wood. The present invention may also include any number of doors 8, 6, and shelves 20, with their corresponding features. The present invention may also be expanded to have a plurality of shelves 20 and doors 8, 6, side by side, extending the width of the device up to a maximum of the framing distance between studs, which is fourteen inches in most current U.S. construction codes. The knobs 26 may be connected to the knob mount 12 by a suitable screw, rivet, press fit, nut, or adhesive. The hinges 22 may also a suitable screw, rivet, press fit, nut, or adhesive. In the case of an adhesive being used, any suitable substance may be used, including but not limited to: cyanoacrylates, epoxies, ultraviolet curing compounds, pressure activated adhesives, silicones, polyurethane, hot melt glue, wood glue, thermal bonding, capacitive discharge welding, welding, ultrasonic welding.

Figure 20:
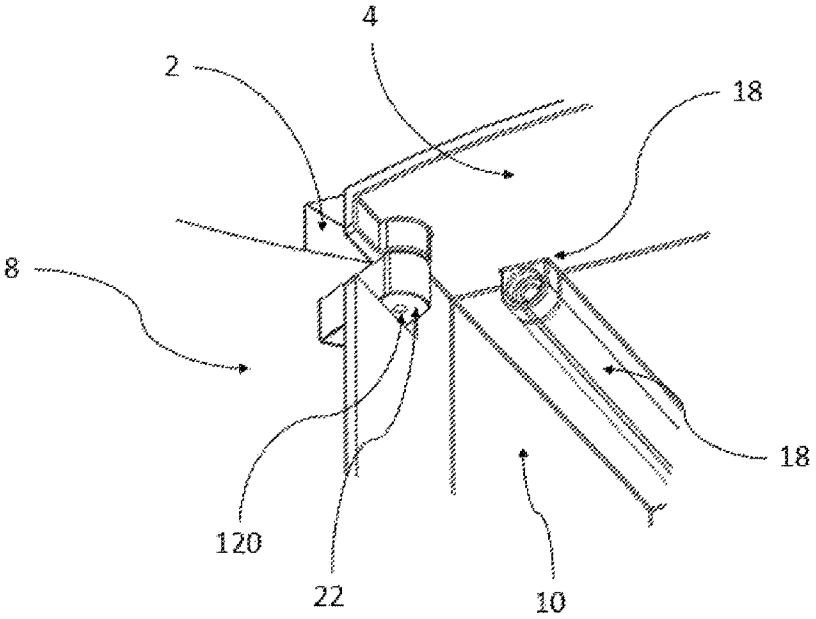
FIG. 20 is an enlarged interior perspective of the hinge mechanism shown in FIGS. 1-19.
Figure 19:
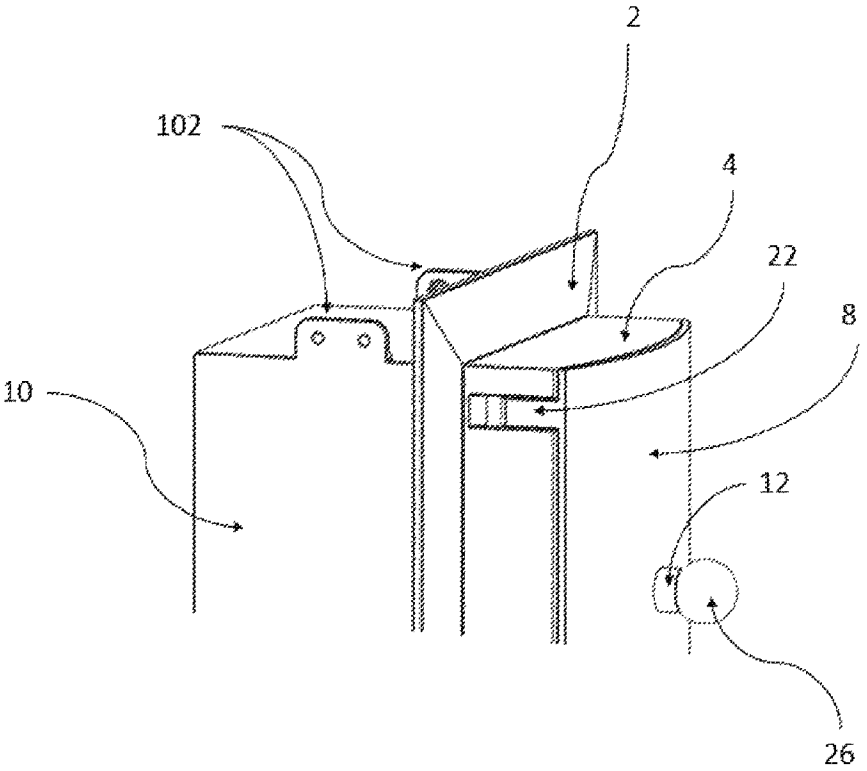
FIG. 19 is another perspective view of a portion of either of the above illustrated embodiments, showing in enlarged detail an exemplary embodiment of the hinge mechanism of FIGS. 1-18 for the inventive enclosure.

Now referring to FIGS. 19 and 20, an interior view of the top hinge 22 on the top door 8, a hinge removal hole 120 may be placed on one or more of the hinges 22 for easy removal of the doors 6, 8, allowing for modularity. This modularity allows for simple replacement or customization of the doors 6, 8.

What is claimed is:

1. A wall-mounted storage system, comprising:

an enclosure comprising a shelf structure having a back wall, opposing side walls, a bottom wall, and a top wall, an interior volume defined by the back wall, opposing side walls, the top wall, and the bottom wall, and a front opening;

at least one door secured to one of the opposing side walls by a plurality of vertically spaced hinges, the hinges permitting movement of the at least one door between a closed position wherein the at least one door covers the front opening and an open position, wherein the front opening is exposed for access to the interior volume;

a trim structure extending outwardly from each of the top wall, bottom wall, and opposing side walls so that the trim structure surrounds the entire enclosure;

a plurality of vertically spaced shelves, in the shelf structure, removably secured within the interior volume of the enclosure;

mounting tabs disposed on opposing ends of each of the top wall and the bottom wall, the mounting tabs being adapted for securement of the enclosure to adjacent wall structure to mount the enclosure to a room wall;

the trim structure further comprising a protruding structure, the protruding structure extending the shelves, the opposing side walls, the top wall, and the bottom wall forwardly from a plane of the room wall when the enclosure is mounted to the room wall; and trim attachment holes disposed in the shelf structure which are adapted to receive fasteners which attach the trim structure to the shelf structure;

wherein when the enclosure is mounted to the room wall, the trim structure is adapted to lie flush on an exterior surface of the room wall and to cover any gap between the room wall and the shelf structure, and further wherein the plurality of vertically spaced hinges are disposed on the protruding structure, the protruding structure further comprising a plurality of vertically spaced receiving magnet holders, the plurality of vertically spaced receiving magnet holders being disposed on the opposing side of the protruding structure, relative to the plurality of vertically spaced hinges, the plurality of vertically spaced receiving magnet holders being engageable with a corresponding plurality of magnet holders disposed on the at least one door, so that when the at least one door is swung to its closed position, engagement of the plurality of magnet holders with corresponding ones of the receiving magnet holders retains the at least one door in its closed position.

2. The bathroom storage system as recited in claim 1, and further comprising a tissue paper roll holder in the interior volume.

3. The wall-mounted storage system as recited in claim 1, wherein the plurality of hinges are recessed within outer boundaries of the trim structure when the at least one door is in its closed position, one or more of the plurality of hinges comprising a hinge removal hole to facilitate easy removal of the at least one door for purposes of modularity.

4. The wall-mounted storage system as recited in claim 1, wherein each of the mounting tabs comprises a flange having a pair of spaced fastener holes disposed therein, each of the mounting tabs being adapted for attachment to adjacent framing studs.

5. A wall-mounted storage system, comprising:

an enclosure comprising a shelf structure having a back wall, opposing side walls, a bottom wall, and a top wall, an interior volume defined by the back wall, opposing side walls, the top wall, and the bottom wall, and a front opening;

at least one door secured to one of the opposing side walls by a plurality of vertically spaced hinges, the hinges permitting movement of the at least one door between a closed position wherein the at least one door covers the front opening and an open position, wherein the front opening is exposed for access to the interior volume;

a trim structure extending outwardly from each of the top wall, bottom wall, and opposing side walls so that the trim structure surrounds the entire enclosure;

a plurality of vertically spaced shelves, in the shelf structure, removably secured within the interior volume of the enclosure;

mounting tabs disposed on opposing ends of each of the top wall and the bottom wall, the mounting tabs being adapted for securement of the enclosure to adjacent wall structure to mount the enclosure to a room wall;

wherein when the enclosure is mounted to the room wall, the trim structure is adapted to lie flush on an exterior surface of the room wall and to cover any gap between the room wall and the shelf structure;

and further wherein each of the mounting tabs further comprise a mounting tab slide having a lip, wherein the mounting tabs and mounting tab slides are adapted to clamp adjacent drywall against the lip of the mounting tab slide to thereby secure the shelf structure to the drywall.

6. The wall-mounted storage system as recited in claim 5, wherein the mounting tabs are free-floating and rotatable to lie flat along the top wall of the shelf structure when the shelf structure is inserted into a hole in the drywall, and then are rotatable to extend upwardly to secure the shelf structure to the wall.

* * * * *